US011786098B2

(12) United States Patent
Kim

(10) Patent No.: US 11,786,098 B2
(45) Date of Patent: Oct. 17, 2023

(54) AI ROBOT CLEANER AND ROBOT SYSTEM HAVING THE SAME

(71) Applicant: LG ELECTRONICS INC., Seoul (KR)

(72) Inventor: Gangeun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 526 days.

(21) Appl. No.: 16/943,539

(22) Filed: Jul. 30, 2020

(65) Prior Publication Data

US 2021/0030240 A1 Feb. 4, 2021

(30) Foreign Application Priority Data

Jul. 31, 2019 (KR) ..... 10-2019-0093474

(51) Int. Cl.
*A47L 11/40* (2006.01)
*A47L 11/282* (2006.01)

(52) U.S. Cl.
CPC ..... *A47L 11/4011* (2013.01); *A47L 11/282* (2013.01); *A47L 11/4038* (2013.01);
(Continued)

(58) Field of Classification Search
CPC ..... A47L 11/282; A47L 11/4011; A47L 11/4061; A47L 11/4063; A47L 11/4066;
(Continued)

(56) References Cited

U.S. PATENT DOCUMENTS

2005/0245413 A1 11/2005 Baltes et al.
2014/0166047 A1* 6/2014 Hillen ..... A47L 9/30 15/49.1

(Continued)

FOREIGN PATENT DOCUMENTS

CN 203334230 U 12/2013
CN 107456173 A 12/2017

(Continued)

OTHER PUBLICATIONS

Search Report issued in Taiwanese Application No. 109125640, dated Nov. 10, 2021 (4 pages).

(Continued)

*Primary Examiner* — Orlando E Aviles
*Assistant Examiner* — Abbie E Quann
(74) *Attorney, Agent, or Firm* — Birch, Stewart, Kolasch & Birch, LLP

(57) ABSTRACT

A robot cleaner of the present disclosure includes: a robot cleaner including: a main body forming an outer shape; a water tank configured to contain water; a pair of rotary mops configured to rotate in contact with a floor to move the main body; a drive motor configured to rotate the pair of rotary mops; a pump connected to the water tank for injecting the water to the rotary mop; and a controller configured to determine whether the water in the water tank is insufficient based on an output current of the drive motor indicating a water content of the rotary mops. Accordingly, the robot (Continued)

cleaner may be effective in terms of cost and space utilization because it does not have a separate water quantity sensor and can measure the water quantity of the rotary mop of the robot cleaner.

19 Claims, 11 Drawing Sheets

(52) U.S. Cl.
CPC ..... *A47L 11/4061* (2013.01); *A47L 11/4066* (2013.01); *A47L 11/4069* (2013.01); *A47L 11/4083* (2013.01); *A47L 11/4088* (2013.01); *A47L 11/4091* (2013.01); *A47L 2201/022* (2013.01); *A47L 2201/04* (2013.01); *A47L 2201/06* (2013.01)

(58) Field of Classification Search
CPC ..... A47L 11/4069; A47L 11/408; A47L 11/4083; A47L 11/4088; A47L 11/4091; A47L 2201/022; A47L 2201/04; A47L 2201/06
USPC ..... 15/98
See application file for complete search history.

(56) References Cited

U.S. PATENT DOCUMENTS

| | | | | |
|---|---|---|---|---|
| 2014/0366292 | A1 | 12/2014 | Jung et al. | |
| 2019/0038105 | A1* | 2/2019 | Park | A47L 9/28 |
| 2022/0032450 | A1* | 2/2022 | Kim | G05B 13/0265 |

FOREIGN PATENT DOCUMENTS

| | | | |
|---|---|---|---|
| JP | 2002-130141 | A | 5/2002 |
| JP | 2003-79990 | A | 3/2003 |
| JP | 2015-163153 | | 9/2015 |
| KR | 10-2014-0146702 | | 12/2014 |
| KR | 10-1672203 | | 11/2016 |
| KR | 10-2018-0134155 | A | 12/2018 |
| KR | 10-2019-0015930 | | 2/2019 |
| KR | 10-1974870 | | 5/2019 |
| TW | 201909822 | A | 3/2019 |

OTHER PUBLICATIONS

International Search Report in PCT/KR2020/010089, dated Dec. 1, 2020 (3 pages).

* cited by examiner

AI ROBOT CLEANER AND ROBOT SYSTEM HAVING THE SAME

CROSS-REFERENCE TO RELATED APPLICATION

This application claims priority under 35 USC § 119 to Korean Application No. 10-2019-0093474, filed on Jul. 31, 2019, whose entire disclosure is hereby incorporated by reference.

TECHNICAL FIELD

The present disclosure relates to a robot cleaner and a method for controlling the robot cleaner, and more particularly, to a control method of an artificial intelligence robot cleaner using a rotary mop.

BACKGROUND

Recently, the use of robots in the home is gradually increasing. A representative example of such a home robot is a cleaning robot. The cleaning robot is a moving robot that travels on a certain zone by itself, and sucks foreign matter such as dust accumulated on the floor to clean a cleaning space automatically, or can be moved by using a rotary mop and perform cleaning by using the rotary mop to wipe the floor. In addition, is also possible to mop the floor by supplying water to the rotary mop.

However, if the water supplied to the rotary mop is not properly adjusted, there is a problem in that the floor cannot be cleaned appropriately, as if excessive water is remained on the floor to be cleaned or the floor is wiped with a dry mop. In the case of Korean Publication Patent No. 1020040052094, a cleaning robot capable of performing water cleaning, while including a mop roller having a mop cloth on its outer circumferential surface to wipe off the steam sprayed on the floor with dust, is disclosed. Such a cleaning robot sprays steam on the surface of the cleaning floor for wet cleaning, and has a cloth for mop to wipe off the sprayed steam and dust. In addition, Korean Publication Patent No. 20140146702 discloses a robot cleaner for determining whether water can be accommodated inside a robot cleaner capable of performing wet cleaning, and a control method thereof.

However, the technology to detect how much water is present in the rotary mop is still silent.

Meanwhile, Korean Patent Publication No. KR20090019480A discloses a robot cleaner equipped with an infrared sensor for simultaneously detecting a step and a threshold as well as a floor and a cliff while traveling a cleaning zone, and Korean Patent Registration No. 10-1412581B1 describes a robot cleaner that detects floors, hills, and cliffs using light quantity.

However, even in this prior art, the robot cleaner performing wet cleaning is equipped with a separate sensor for detecting the current state of the floor, and thus there is a problem of cost and equipment.

Patent Document

Korean Patent Publication No. 1020040052094 (published Jun. 19, 2004)

Korean Patent Publication No. 20140146702 (published Dec. 29, 2014)

Korean Patent Registration No. 10-1412581B1 (published Jun. 16, 2009)

SUMMARY

An object of the present disclosure is to provide a control method of a robot cleaner that does not have a separate water quantity sensor and measures the water quantity of the rotary mop of the robot cleaner.

Another object of the present disclosure is to provide a control method of a robot cleaner that can detect a change in the output current of the motor of the rotary mop of the robot cleaner and determine the water quantity according to the change in the current value.

Another object of the present disclosure is to provide a control method of a robot cleaner that can read the output current value of the rotating motor and determine the current floor state accordingly.

Another object of the present disclosure is to provide a control method of a robot cleaner that can induce a user to solve the problem by determining the water quantity of the robot cleaner and providing an alarm for this through an application of the user terminal.

The present disclosure is not limited to the problems mentioned above, and other problems not mentioned will be clearly understood by those skilled in the art from the following description.

In an aspect, there is provided a robot cleaner including: a main body configured to form an outer shape; a water tank configured to contain water; a pair of rotary mop configured to move the main body while rotating in contact with a floor; a drive motor configured to rotate the pair of rotary mop; a pump configured to be connected to the water tank and drive a nozzle that inject the water to the rotary mop; and a controller configured to determine whether the water in the water tank is insufficient by reading the output current of the drive motor to determine the water content of the rotary mop when the pair of rotary mops rotate.

The controller periodically reads the output current of the driving motor, and determines that the water in the water tank is insufficient when the output current is less than a threshold value.

The threshold value corresponds to the minimum value of the wet-cleanable water content.

The controller determines by fusion of the operating state of the pump when the controller determines whether the water is insufficient by comparing the threshold value and the output current of the drive motor.

The controller determines that the water tank is running out of water when the output current of the drive motor is less than the threshold value and the pump is operating normally.

The controller stops the operation of the pump according to selection information from outside, and performs cleaning in a dry mop state when the output current of the drive motor is less than the threshold value.

The controller further reads the output current of the drive motor to determine the current floor state.

The controller determines the current floor state according to a look-up table corresponding to the output current of the drive motor and the floor state.

The controller determines that the floor state is sufficient to perform wet cleaning when the output current of the drive motor satisfies within a threshold range, and performs wet cleaning, and determines that the robot cleaner is restrained when it exceeds the threshold range.

The threshold range of the output current of the drive motor satisfies a predetermined range based on an initial output current of the drive motor at the start of cleaning.

The controller determines the return to a charging station or stop at the current position according to the output current of the drive motor.

The robot cleaner further includes a cliff sensor having one or more light emitting elements and one or more light receiving elements to determine the floor state in the cleaning area, and the controller determines the floor state according to the output current of the drive motor and the amount of light received by the cliff sensor.

In another aspect, there is provided a robot system including: a robot cleaner configured to perform wet cleaning in a cleaning area; a server configured to transmit and receive the robot cleaner and perform control of the robot cleaner; and a user terminal configured to perform control of the robot cleaner by activating an application for interworking with the robot cleaner and the server, and controlling the robot cleaner, wherein the robot cleaner comprises; a pair of rotary mop configured to move a main body while rotating in contact with a floor; a drive motor configured to rotate the pair of rotary mop; a pump configured to be connected to a water tank and drive a nozzle that inject the water to the rotary mop; and a controller configured to determine whether the water in the water tank is insufficient by reading the output current of the drive motor to determine the water content of the rotary mop when the pair of rotary mops rotate.

The controller periodically reads the output current of the driving motor, and determines that the water in the water tank is insufficient when the output current is less than a threshold value.

The controller determines by fusion of the operating state of the pump when the controller determines whether the water is insufficient by comparing the threshold value and the output current of the drive motor.

The controller determines that the water tank is running out of water, and alarms the water shortage information to the user terminal when the output current of the drive motor is less than the threshold value and the pump is operating normally.

The user terminal controls the operation of the robot cleaner by displaying an icon corresponding to dry mop cleaning or cleaning stop and transmitting selected information to the robot cleaner. when the output current of the drive motor is less than the threshold value.

The controller further reads the output current of the drive motor to determine the current floor state.

The controller determines the current floor state according to a look-up table corresponding to the output current of the drive motor and the floor state.

The controller determines that the floor state is sufficient to perform wet cleaning when the output current of the drive motor satisfies within a threshold range, and performs wet cleaning, and alarms to the user terminal that the robot cleaner is restrained when it exceeds the threshold range.

According to the robot cleaner of the present disclosure, there are one or more of the following effects.

The present disclosure can provide the robot cleaner that is effective in cost and space utilization because it does not have a separate water quantity sensor and can measure the water quantity of the rotary mop of the robot cleaner.

In addition, by detecting a change in the output current of the motor of the rotary mop of the robot cleaner, the water quantity can be determined according to the change in the current value, and the current floor state can be determined.

And, by determining the water quantity of the robot cleaner and providing an alarm for this through the application of the user terminal, it is possible to induce the user to solve the problem.

The effects of the present disclosure are not limited to the effects mentioned above, and other effects not mentioned will be clearly understood by those skilled in the art from the description of the claims.

DETAILED DESCRIPTION

Figure 1:
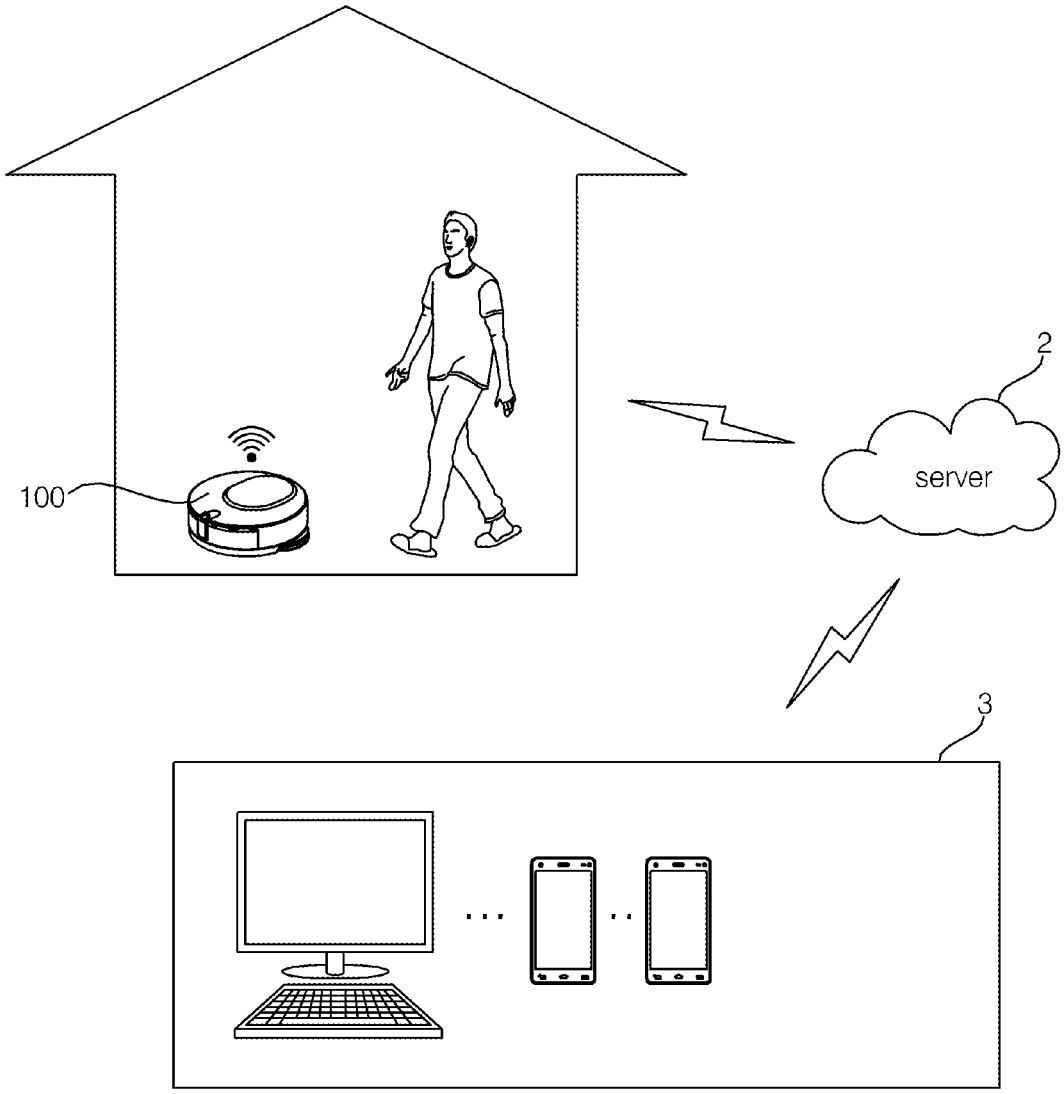
FIG. 1 is a constitutional view of a robot cleaner system including a robot cleaner according to an embodiment of the present disclosure.

Expressions referring to directions such as "front (F)/rear (R)/left (Le)/right (Ri)/upper (U)/lower (D)" mentioned below are defined based on the illustrations in the drawings, but this is merely given to describe the present disclosure for clear understanding thereof, and it goes without saying that the respective directions may be defined differently depending on where the reference is placed.

The use of terms in front of which adjectives such as "first" and "second" are used in the description of constituent elements mentioned below is intended only to avoid confusion of the constituent elements, and is unrelated to the order, importance, or relationship between the constituent elements. For example, an embodiment including only a second component but lacking a first component is also feasible.

The thickness or size of each constituent element shown in the drawings may be exaggerated, omitted or schematically drawn for the convenience and clarity of explanation. The size or area of each constituent element may not utterly reflect the actual size or area thereof.

Angles or directions used to describe the structure of the present disclosure are based on those shown in the drawings. Unless a reference point with respect to an angle or positional relationship in the structure of the present disclosure is clearly described in the specification, the related drawings may be referred to.

FIG. 1 is a constitutional view of an artificial-intelligence robot system according to an embodiment of the present disclosure.

Referring to FIG. 1, the robot system according to the embodiment of the present disclosure may include at least one robot cleaner 100 for providing a service in a prescribed place such as a house. For example, the robot system may include a home robot cleaner 100, which interacts with a user at home and provides various forms of entertainment to the user. In addition, the home robot cleaner 100 may perform online shopping or online ordering and may provide a payment service in accordance with the user request.

Preferably, the robot system according to the embodiment of the present disclosure may include a plurality of artificial-intelligence robot cleaners 100 and a server 2 capable of managing and controlling the plurality of artificial-intelligence robot cleaners 100. The server 2 may monitor and control the status of the plurality of robots 1 from a remote place, and the robot system may provide a service more effectively using the plurality of robots 1.

The plurality of robot cleaners 100 and the server 2 may include a communication module (not shown), which supports one or more communication standards, so as to communicate with each other. In addition, the plurality of robot cleaners 100 and the server 2 may communicate with a PC, a mobile terminal, and another external server 2.

For example, the plurality of robot cleaners 100 and the server 2 may implement wireless communication using a wireless communication technology such as IEEE 802.11 WLAN, IEEE 802.15 WPAN, UWB, Wi-Fi, ZigBee, Z-wave, Bluetooth, or the like. The robot cleaners 100 may be configured differently depending on the type of communication of other devices, with which the robot cleaners 100 intend to communicate, or the server 2.

In particular, the plurality of robot cleaners 100 may communicate with another robot cleaner 100 and/or the server 2 in a wireless manner over a 5G network. When the robot cleaners 100 implement wireless communication over a 5G network, real-time response and real-time control are possible.

The user may confirm information on the robot cleaners 100 in the robot system through a user terminal 3 such as a PC or a mobile terminal.

The server 2 may be implemented as a cloud server 2, and the cloud server 2 may be interlocked with the robot cleaners 100 so as to monitor and control the robot cleaners 100 and remotely provide various solutions and contents.

The server 2 may store and manage information received from the robot cleaners 100 and other devices. The server 2 may be a server 2 that is provided by a manufacturer of the robot cleaners 100 or a company entrusted with the service by the manufacturer. The server 2 may be a control server 2 that manages and controls the robot cleaners 100.

The server 2 may control the robot cleaners 100 collectively and uniformly, or may control the robot cleaners 100 individually. Meanwhile, the server 2 may be implemented as multiple servers to which pieces of information and functions are dispersed, or may be implemented as a single integrated server.

The robot cleaners 100 and the server 2 may include a communication module (not shown), which supports one or more communication standards, for communication therebetween.

The robot cleaners 100 may transmit data related to space, objects, and usage to the server 2.

Here, the data related to space and objects may be data related to recognition of space and objects that is recognized by the robot cleaners 100, or may be image data on space and objects that is acquired by an image acquisition unit.

Depending on the embodiment, the robot cleaners 100 and the server 2 may include artificial neural networks (ANN) in the form of software or hardware that has learned to recognize at least one of a user, a voice, properties of space, or properties of an object such as an obstacle.

According to the embodiment of the present disclosure, the robot cleaners 100 and the server 2 may include a deep neural network (DNN), such as a convolutional neural network (CNN), a recurrent neural network (RNN), or a deep belief network (DBN), which has been trained through deep learning. For example, the controller 140 of each robot cleaner 100 may be equipped with a deep neural network (DNN) structure such as a convolutional neural network (CNN).

The server 2 may train the deep neural network (DNN) based on data received from the robot cleaners 100 or data input by the user, and thereafter may transmit the updated data on the deep neural network (DNN) structure to the robots 1. Accordingly, the artificial-intelligence deep neural network (DNN) structure provided in the robot cleaners 100 may be updated.

Data related to usage may be data acquired in accordance with use of the robot cleaners 100. Data on use history or a sensing signal acquired through a sensor unit 110 may correspond to the data related to usage.

The trained deep neural network (DNN) structure may receive input data for recognition, may recognize properties of people, objects, and space included in the input data, and may output the result of recognition.

In addition, the trained deep neural network (DNN) structure may receive input data for recognition, may analyze and learn data related to usage of the robot cleaners 100, and may recognize a usage pattern and a usage environment.

Meanwhile, the data related to space, objects, and usage may be transmitted to the server 2 via a communication unit.

The server 2 may train the deep neural network (DNN) based on the received data, and thereafter may transmit the updated data on the deep neural network (DNN) structure to the artificial-intelligence robot cleaners 100 so that the robots update the deep neural network (DNN) structure.

Accordingly, the robot cleaners 100 may continually become smarter, and may provide a user experience (UX) that evolves as the robot cleaners 100 are used.

Meanwhile, the server 2 can provide information about the control and the current state of the robot cleaner 100 to the user terminal, and can generate and distribute an application for controlling the robot cleaner 100.

Such an application may be an application for a PC applied as the user terminal 3 or an application for a smartphone.

For example, it may be an application for controlling a smart home appliance, such as a SmartThinQ application, which is an application that can simultaneously control and manage various electronic products of the present applicant.

Figure 2:
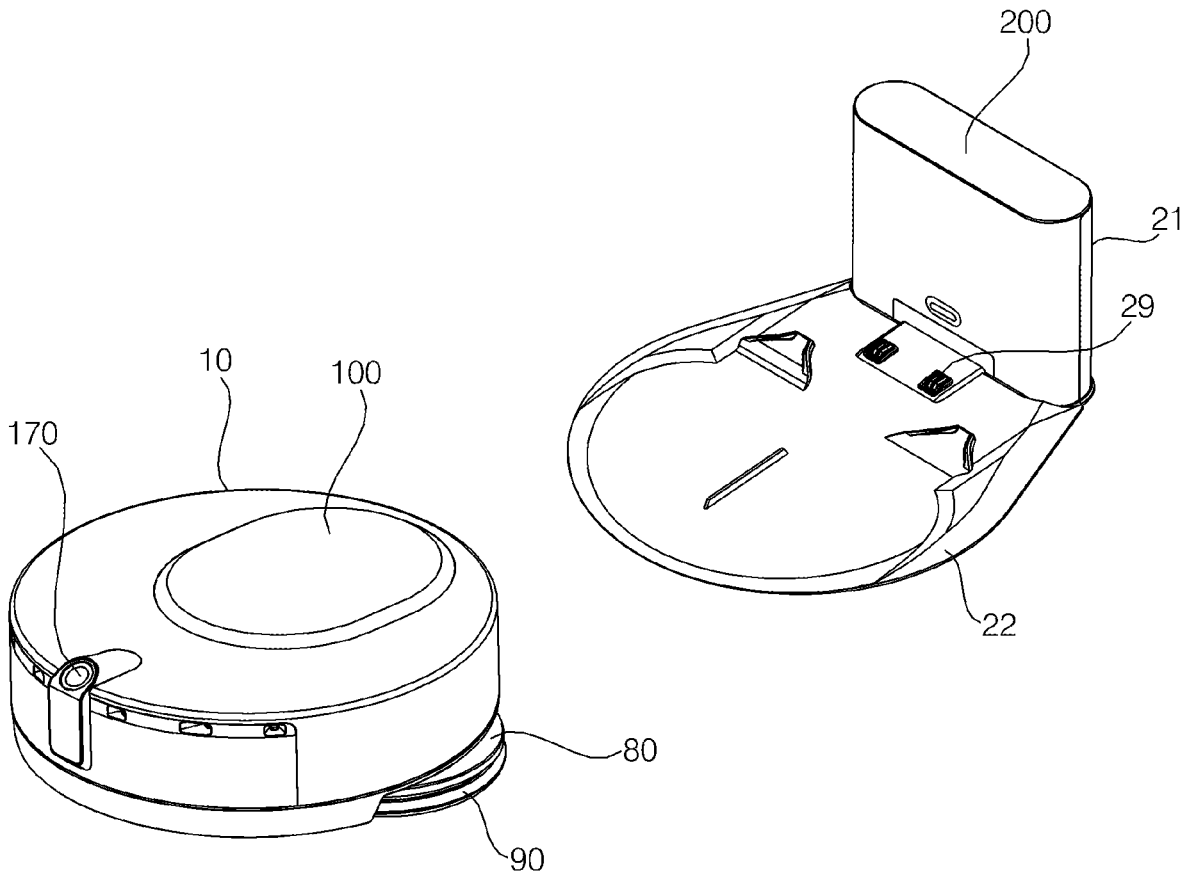
FIG. 2 is a perspective view of a robot cleaner according to an embodiment of the present disclosure.
Figure 3:
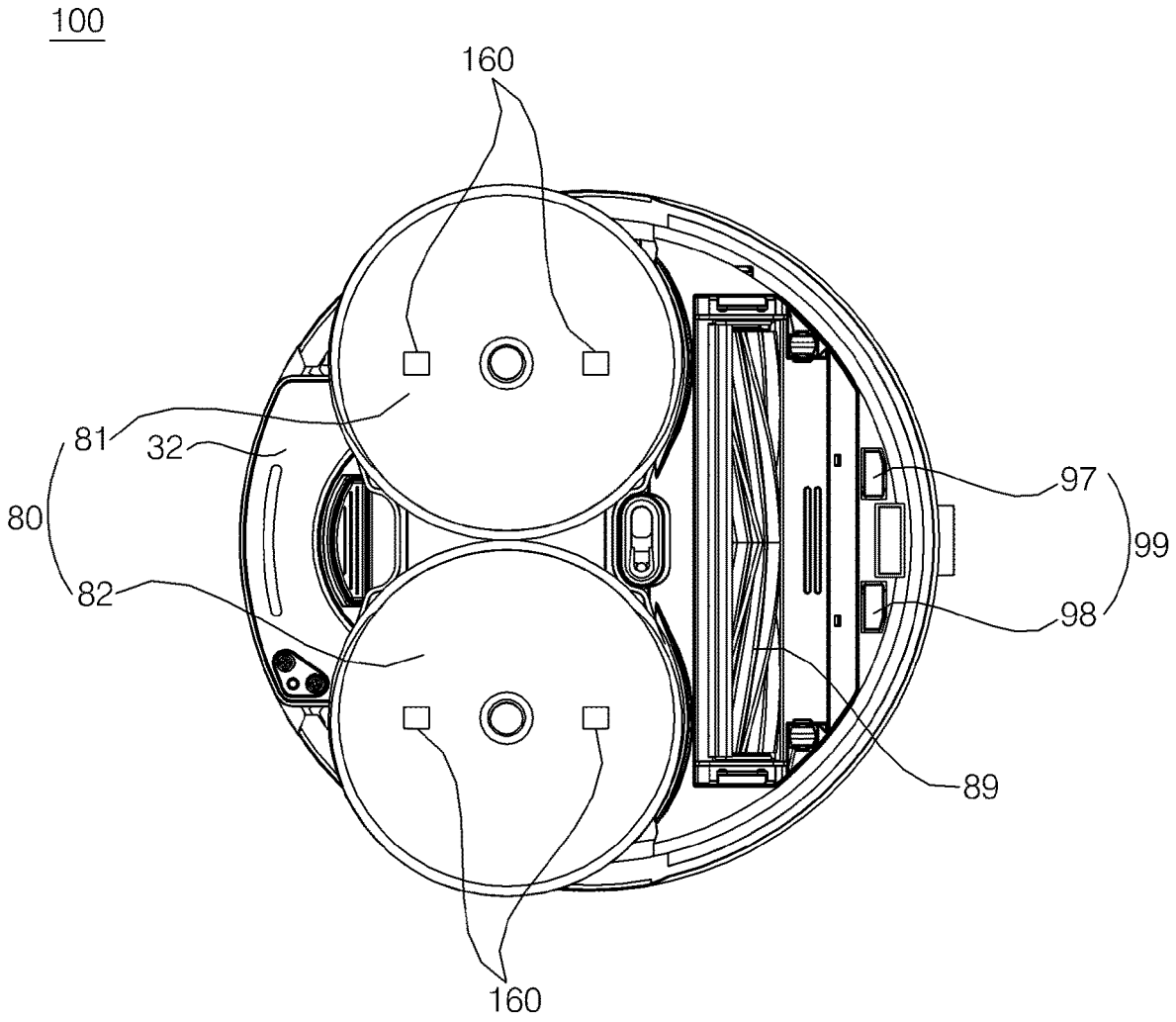
FIG. 3 is a bottom view of the robot cleaner of FIG. 2.
Figure 4:
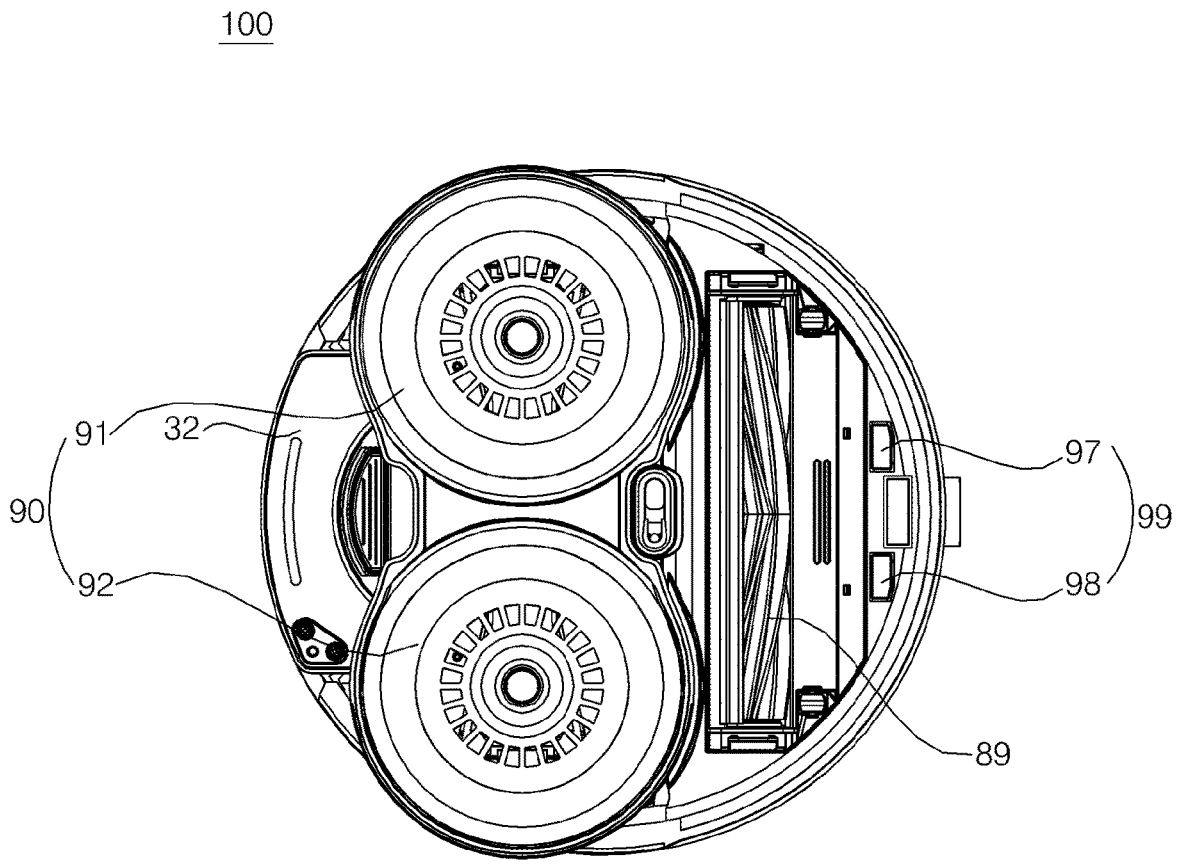
FIG. 4 is another state diagram of the bottom view of the robot cleaner of FIG. 3.

FIG. 2 is a perspective view of a robot cleaner according to an embodiment of the present disclosure, FIG. 3 is a bottom view of the robot cleaner of FIG. 2, and FIG. 4 is another state diagram of the bottom view of the robot cleaner of FIG. 3.

Referring to FIGS. 2 to 4, the configuration of the robot cleaner 100 in motion by the rotation of the rotary mop according to the present embodiment will be described briefly.

The robot cleaner 100 according to an embodiment of the present disclosure moves in a zone, and removes foreign matter on the floor during traveling.

In addition, the robot cleaner 100 stores the charging power supplied from a charging station 200 in a battery (not shown) and travels the zone.

The robot cleaner 100 includes a main body 10 performing a designated operation, an obstacle detecting unit (not shown) which is disposed in the front surface of the main body 10 and detects an obstacle, and an image acquisition unit 170 photographing a 360 degree image. The main body 10 includes a casing (not shown) which forms an outer shape and forms a space in which components constituting the main body 10 are accommodated, a rotary mop 80 which is rotatably provided, a roller 89 which assists movement of the main body 10 and the cleaning, and a charging terminal 99 to which charging power is supplied from the charging station 2.

The rotary mop 80 is disposed in the casing and formed toward the floor surface and the mop cloth is configured to be detachable. The rotary mop 80 includes a first rotating plate 81 and a second rotating plate 82 to allow the body 10 to move along the floor of the zone through rotation.

The robot cleaner 100 according to the present embodiment may further include a water tank 32 which is disposed inside the main body 10 and stores water, a pump 34 for supplying water stored in the water tank 32 to the rotary mop 80, and a connection hose for forming a connection flow path connecting the pump 34 and the water tank 32 or connecting the pump 34 and the rotary mop 80.

The robot vacuum cleaner 100 according to the present embodiment includes a pair of rotary mops 80 and moves by rotating the pair of rotary mops 80.

The main body 10 travels forward, backward, left, and right as the first rotating plate 81 and the second rotating plate 82 of the rotary mop 80 rotate about a rotating shaft. In addition, as the first and second rotating plates 81 and 82 rotate, the main body 10 performs wet cleaning as foreign matter on the floor surface is removed by the attached mop cloth.

The main body 10 may include a driving unit (not shown) for driving the first rotating plate 81 and the second rotating plate 82. The driving unit may include at least one drive motor 38.

The upper surface of the main body 10 may be provided with a control panel including an operation unit (not shown) that receives various commands for controlling the robot cleaner 100 from a user.

In addition, the image acquisition unit 170 is disposed in the front or upper surface of the main body 10.

The image acquisition unit 170 captures an image of an indoor area.

On the basis of the image captured by the image acquisition unit 170, it is possible to detect obstacles around the main body as well as to monitor the indoor area.

The image acquisition unit 170 may be disposed toward the front and upper direction at a certain angle to photograph the front and the upper side of the moving robot. The image acquisition unit 170 may further include a separate camera for photographing the front. The image acquisition unit 170 may be disposed above the main body 10 to face a ceiling, and in some cases, a plurality of cameras may be provided. In addition, the image acquisition unit 170 may be separately provided with a camera for photographing the floor surface.

The robot cleaner 100 may further include position obtaining means (not shown) for obtaining current position information. The robot cleaner 100 may include GPS and UWB to determine the current position. In addition, the robot cleaner 100 may determine the current position by using the image.

The main body 10 includes a rechargeable battery (not shown), and a charging terminal 99 of the battery may be connected to a commercial power source (e.g., a power outlet in a home) or the main body 10 may be docked to the charging station 200 connected to the commercial power source, so that the charging terminal may be electrically connected to the commercial power source through contact with a terminal 29 of the charging station and the battery may be charged by the charging power supplied to the main body 10.

The electric components constituting the robot cleaner 100 may be supplied with power from a battery, and thus, the robot cleaner 100 may automatically move in a state in which the robot cleaner 100 is electrically separated from commercial power.

Hereinafter, it will be described on the assumption that the robot cleaner 100 is a wet cleaning moving robot. However, the robot cleaner 100 is not limited thereto and it should be noted that any robot that detects sound while autonomously traveling a zone can be applicable.

The rotary mop 80 used in the robot cleaner 100 of this embodiment is equipped with a micro pad or a fabric-type mop pad. Therefore, when rotating the rotary mop 80, a slip occurs that the robot cleaner 100 does not move compared to the rotation of the actual rotary mop 80. The rotary mop 80 may include a rolling mop driven by a rotational axis parallel to the floor, or a spin-mop driven by a rotational axis substantially perpendicular to the floor. Hereinafter, the method of measuring the water quantity of the rotary mop 80 based on the spin mop, which is one form of the rotary mop 80 will be described.

Hereinafter, the slip rate refers to the degree of slip generated as the rotary mop 80 rotates on the bottom surface, and in a state where the slip rate is '0', the robot cleaner 100 may move at an ideal rotation speed.

In addition, the water quantity refers to the degree to which the rotary mop 80 contains water, and a state in which the water quantity is '0' means a condition in which water is not included in the rotary mop 80 at all. The water quantity according to this embodiment may be set to a ratio including water according to the weight of the map pad. It is also possible that the rotary mop 80 contains water of the same weight as the weight of the mop pad, or contains water in excess of the weight of the mop pad.

The slip rate may appear differently depending on the water quantity, which is the degree to which the rotary mop 80 contains water. The higher the water quantity of the rotary mop 80, which contains a lot of water, the more the frictional force with the bottom surface is generated by the influence of water, thereby reducing the rotational speed.

Decreasing the rotational speed of the motor 38 means that the torque of the motor 38 is increased, and accordingly, the output current of the drive motor 38 that rotates the rotary mop 80 is increased.

That is, a relationship in which the output current of the drive motor 38 that rotates the rotary mop 80 increases due to the increased frictional force when the water quantity increases is established.

Accordingly, as the output current of the drive motor 38 is measured, it is possible to determine the state of the water quantity of the current rotary mop 80.

The relationship between the output current and the water quantity of the drive motor 38 can be experimentally identified, and can be stored as data in the storage unit 130 described below. In addition, the slip rate and the output current of the drive motor 38 may appear differently depending on the material of the floor, and this can also be experimentally identified and stored as data in the storage unit 130.

The robot cleaner 100 according to the present embodiment is disposed inside the main body 10, a water tank 32 for storing water, and a pump 34 for supplying water stored in the water tank 32 to the rotary mop 80), and may further include a connecting hose that forms a connecting passage connecting the pump 34 and the water tank 32 or the pump 34 and the rotary mop 80. The robot cleaner 100 according to the present exemplary embodiment may supply water stored in the water tank 32 to the rotary mop 80 using a water supply valve (not shown) without a separate pump.

The robot cleaner 100 according to the present exemplary embodiment may be disposed in such a manner that the rotary mop 80 is inclined by a predetermined angle relative to the bottom surface. To facilitate the movement of the robot cleaner 100, it does not come into contact with the bottom surface evenly on the entire surface of the rotary mop 80, but is inclined by a certain angle (θ) and is arranged to mainly contact at a certain portion of the rotary mop 80. In addition, even if it comes into contact with the bottom surface on the entire surface of the rotary mop 80, it is also possible to arrange it to generate the most frictional force in a certain portion.

FIG. 4 is a diagram illustrating an embodiment in which a mop cloth is attached to the moving robot of FIG. 2.

As shown in FIG. 4, the rotary mop 80 includes a first rotating plate 81 and a second rotating plate 82.

The first rotating plate 81 and the second rotating plate 82 may be provided with attached mop cloth 90(91, 92), respectively.

The rotary mop 80 is configured such that mop cloth 90(91, 92) can be detachable. The rotary mop 80 may have a mounting member for attachment of the mop cloth 90(91, 92) provided in the first rotating plate 81 and the second rotating plate 82, respectively. For example, the rotary mop 80 may be provided with a velcro, a fitting member, or the like so that the mop cloth 90(91, 92) can be attached and fixed. In addition, the rotary mop 80 may further include a mop cloth frame (not shown) as a separate auxiliary means for fixing the mop cloth 90(91, 92) to the first rotating plate 81 and the second rotating plate 82.

The mop cloth 90 absorbs water to remove foreign matter through friction with the floor surface. The mop cloth 90 is preferably a material such as cotton fabric or cotton blend, but any material containing moisture in a certain ratio or higher and having a certain density can be used, and the material is not limited.

The mop cloth 90 is formed in a circular shape.

The shape of the mop cloth 90 is not limited to the drawing and may be formed in a quadrangle, polygon, or the like. However, considering the rotational motion of the first and second rotating plates 81 and 82, it is preferable that the first and second rotating plates 81 are configured in a shape that does not interfere with the rotation operation of the first and second rotating plates 81 and 82. In addition, the shape of the mop cloth 90 can be changed into a circular shape by the mop cloth frame provided separately.

The rotary mop 80 is configured such that when the mop cloth 90 is mounted, the mop cloth 90 comes into contact with the floor surface. Considering the thickness of the mop cloth 90, the rotary mop 80 is configured to change a separation distance between a casing and the first and second rotating plates 81 and 82 according to the thickness of the mop cloth 90.

The rotary mop 80 adjusts the separation distance between the casing and the rotating plate 81, 82 so that the mop cloth 90 comes in contact with the floor surface, and the rotating plates 81, 82 includes a mop fixing part (not shown) for fixing the mop cloth 90. The mop fixing part may fix the mop cloth 90 in a detachable manner. The mop fixing part may be a velcro or the like disposed below the rotating plate 81, 82. The mop fixing part may be a hook or the like disposed in the edge of the rotating plate 81, 82.

Figure 5:
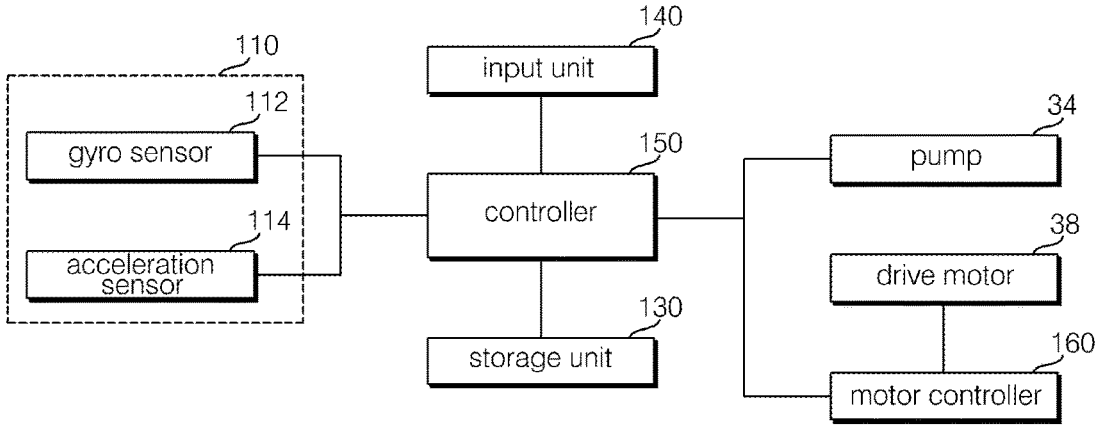
FIG. 5 is a block diagram showing a configuration related to the controller and the controller of the robot cleaner according to an embodiment of the present disclosure.

FIG. 5 is a block diagram showing a configuration related to the controller and the controller of the robot cleaner according to an embodiment of the present disclosure.

The robot cleaner 100 according to the present embodiment further includes a motion detection unit 110 that detects the motion of the robot cleaner 100 according to a reference motion of the main body 10 when the rotary mop 80 rotates. The motion detection unit 110 may further include a gyro sensor 112 that detects the rotational speed of the main body 10 or an acceleration sensor 114 that senses an acceleration value of the robot cleaner 100. In addition, the motion detection unit 110 may use an encoder (not shown) that detects the moving distance of the robot cleaner 100.

The robot cleaner 100 according to the present embodiment includes a motor controller 160 that provides power to the drive motor 38 that rotates the rotary mop 80, reads the output current of the drive motor 38 and sends to the controller 150.

The motor controller 160 may be formed of a separate chip in which simple logic is implemented, and may be integrated with the controller 150 and functionally separated.

The motor controller 160 transmits a current for rotating the drive motor 38 according to the start signal of the controller 150, and reads the output current of the drive motor 38 according to a set period to transmit the output current to the controller 150.

The controller 150 receives the output current from the motor controller 160 and analyzes it to determine the current water quantity of the spin-mop, the slip rate of the spin-mop, and the state of the floor accordingly.

That is, the controller 150 may classify the type of the material of the floor surface on which the robot cleaner 100 moves according to information on the output current of the drive motor 38 into a hard floor, marble, or carpet.

Specifically, the controller 150 may analyze the information on the output current of the drive motor 38 that rotates the spin-mop that is in friction with the floor to determine the material of the current floor surface.

At this time, the controller 150 may acquire a plurality of image information according to a plurality of light sources by using a camera sensor having separate light sources and image sensors, and compare the obtained image information to grasp the material of the floor, but it is not limited thereto.

The robot cleaner 100 may further include a cliff sensor that detects the presence of a cliff on the floor in the cleaning area. The cliff sensor according to the present embodiment may be disposed in the front portion of the robot cleaner 100. In addition, the cliff sensor according to the present embodiment may be disposed on one side of the bumper.

The controller 150 may determine the material of the floor based on the amount of reflected light received from the light-receiving element by reflecting light emitted from the light-emitting element when the cliff sensor is included, but is not limited thereto.

The controller 150 determines the water quantity of the spin-mop of the rotary mop 80 and a predetermined floor state according to the value of the output current of the drive motor 38.

Specifically, the controller 150 reads the data according to the relationship between the data stored in the storage unit 130, for example, the water quantity, the floor state, and the output current, organized into a look-up table, to determine the specific water quantity and the floor state.

For example, the controller 150 stores the threshold value for the corresponding output current value as data with respect to the output current value and the water quantity of the drive motor 38, and compares the obtained output current value with the threshold value data. It can be determined whether the output current value in the period is smaller than the threshold value.

At this time, the controller 150 may read whether the operation of the pump 34 providing water through the nozzle is normally performed, and determine whether the current water supply is abnormal.

That is, even when the operation of the pump 34 proceeds normally, if the output current value is less than the threshold value, it is determined that the amount of water contained in the water tank 32 is insufficient, and accordingly, alarm and operation can be controlled.

Alternatively, when the operation of the pump 34 is not normally performed, alarm and operation according to the malfunction of the pump 34 may be controlled.

Alternatively, if the operation of the pump 34 proceeds normally, and the output current value is greater than or equal to the threshold value, it is determined that the water contained in the water tank 32 maintains a predetermined level so far, and cleaning can be continuously performed.

The controller 150 may control the operation of the robot cleaner 100 by receiving and analyzing the output current value of the drive motor 38 and the operation of the pump 34 together according to a predetermined period.

Meanwhile, the controller 150 reads the output current value of the drive motor 38 according to a predetermined period to determine the slip rate, and determines the state of the floor according to the slip rate.

For example, the controller 150 includes a lookup table corresponding to the slip rate and the output current value in the storage unit 130, and in addition to the lookup table, may include a lookup table corresponding to the slip rate and the floor state.

The corresponding relationship stored in the lookup table may be formed as follows.

TABLE 1

| NO. | 1 | 2 | 3 | 4 | 5 | 6 | 7 |
|---|---|---|---|---|---|---|---|
| Current value (mA) | 200~300 | 301~400 | 401~600 | 601~800 | 801~900 | 901~1000 | over 1,000 |
| Slip rate | S1 | S2 | S3 | S4 | S5 | S6 | S7 |

In addition, the relationship between each slip rate and the floor state may be as follows.

S7: The robot cleaner is locked.

S6: Carpet

S5: Hard floor 3

S4: Hard floor 2

S3: Hard floor 1

S2: Wet floor

S1: Initial state

At this time, the controller 150 can selectively drive according to the floor state by controlling the operation of the robot cleaner 100 according to each floor state.

In addition, the controller 150 may determine the state of the hard floor according to the light information received by the cliff sensor, which may additionally be included, and determine that the more the light received, the higher the slip rate of the floor.

The controller 150 determines the floor state according to the output current value of the drive motor 38 and controls the operation accordingly.

The robot cleaner 100 according to the present embodiment may read the output current value of the drive motor 38 by adding only simple logic to determine the level of the residual water level of the water tank of the current period, and read the slip rate of the spin mop to determine the floor state.

Each data value for the output current value can be set experimentally, and can be updated by learning through artificial intelligence.

The controller 150 may grasp the water quantity of the robot cleaner 100 based on the material of the floor surface identified by the floor detection unit 120 and the slip rate of the robot cleaner 100 measured by a reference motion. The controller 150 may grasp the water quantity based on the data according to the correlation between the slip rate and the water quantity according to the material of the floor surface, which is identified as the floor detection unit 120 and stored in the storage unit 130.

The higher the water quantity is, the closer the moving speed of the ideal robot cleaner 100 in which slip does not occur. The relationship between the specific water quantity and the slip rate may vary depending on the floor material, which can be experimentally identified.

The robot cleaner 100 according to the present embodiment may further include an input unit 140 for inputting a user's command. The user may set a driving method of the robot cleaner 100, the threshold value of the water quantity of the spin-mop, etc. through the input unit 140.

In addition, the robot cleaner 100 may further include a communication unit, and may provide an alarm or information according to the determination result of the controller 150 to the server 2 or the user terminal 3 through the communication unit.

FIG. 6 is a view for explaining the motion of the robot cleaner 100 according to an embodiment of the present invention, with reference to FIG. 6, the traveling of the robot cleaner 100 and the movement of the robot cleaner 100 according to the rotation of the spin mop will be described.

The robot cleaner 100 according to the present embodiment includes a pair of spin mops and rotates a pair of spin mops and moves. The robot cleaner 100 may control the driving of the robot cleaner 100 by varying the rotation direction or rotation speed of each of spin mops.

Figure 6A:
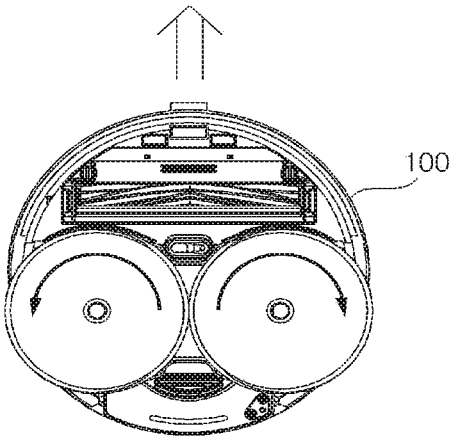
FIGS. 6A to 6C are views for explaining the rotation of the rotary mop when the robot cleaner moves according to an embodiment of the present disclosure.

Referring to FIG. 6*a*, the straight movement of the robot cleaner 100 may be moved by rotating each of the pair of spin mops in opposite directions. In this case, the rotational speed of each of the pair of spin mops is the same, but the rotational directions are different. The robot cleaner 100 may move forward or backward by changing the rotation direction of both spin mops.

Figure 6B:
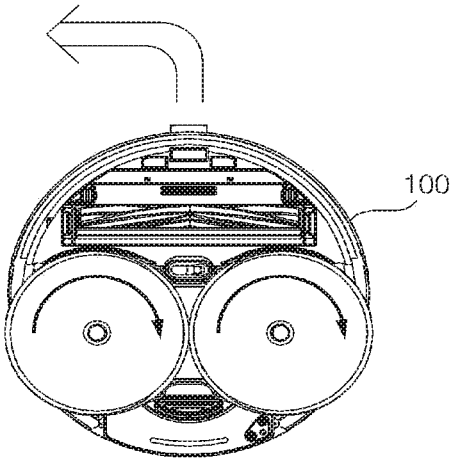
Figure 6C:
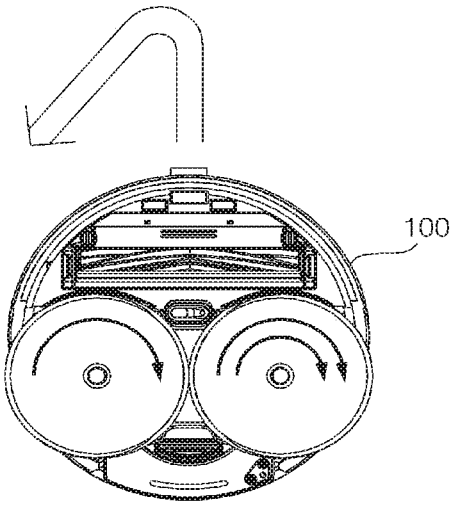

In addition, referring to FIGS. 6*b* and 6*c*, the robot cleaner 100 may rotate by rotating each of a pair of spin mops in the same direction. The robot cleaner 100 may rotate in place by varying the rotational speed of each of the pair of spin mops, or may perform a round rotation moving in a curve. By varying the rotation speed ratio of each of the pair of spin mops of the robot cleaner 100, the radius of the round rotation can be adjusted.

Hereinafter, a method of controlling the water quantity of the robot cleaner 100 according to the present embodiment will be described with reference to FIGS. 7 to 9.

Figure 7:
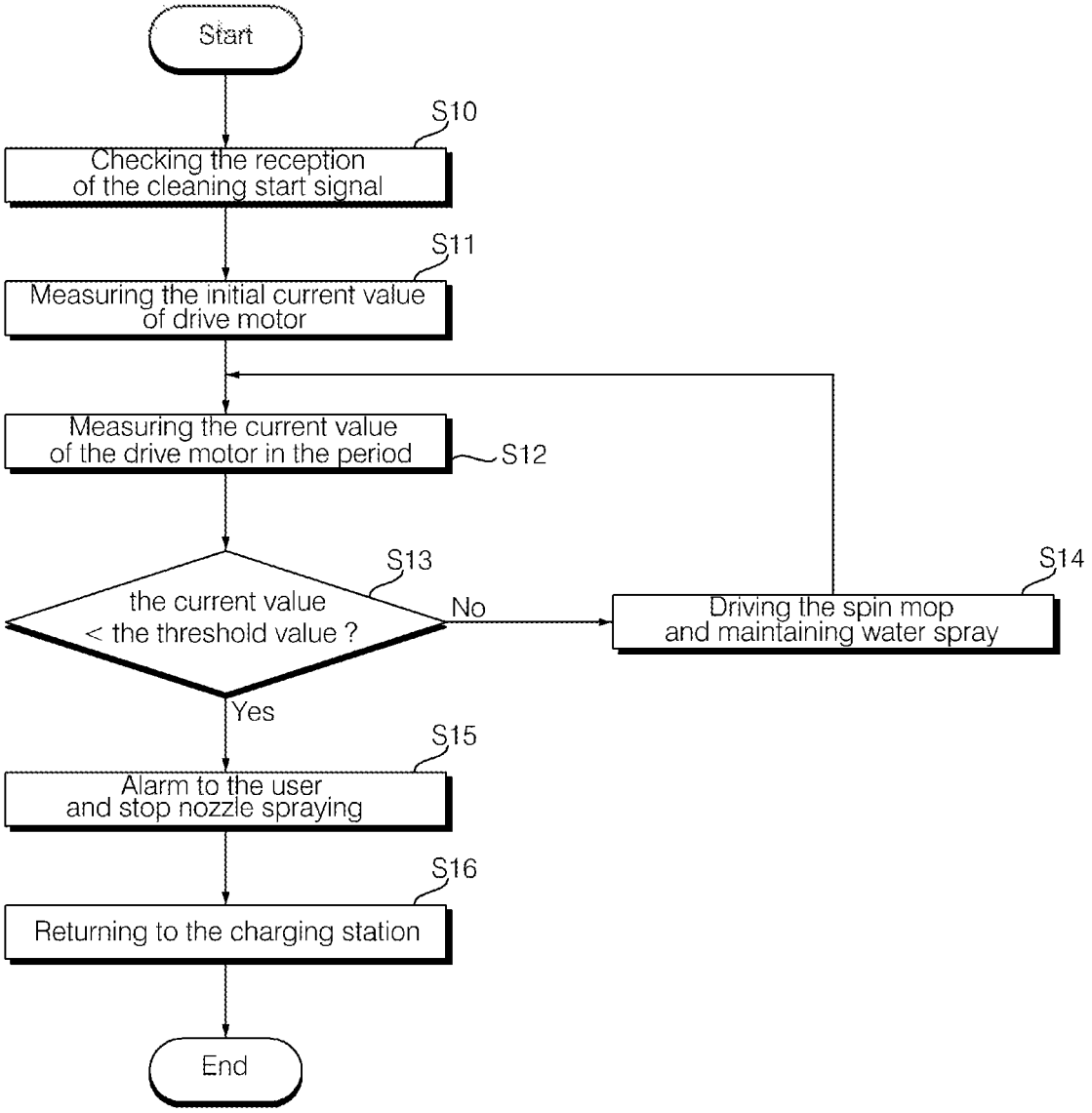
FIG. 7 is a flowchart illustrating a control method of the robot cleaner according to an embodiment of the present disclosure.
Figure 8:
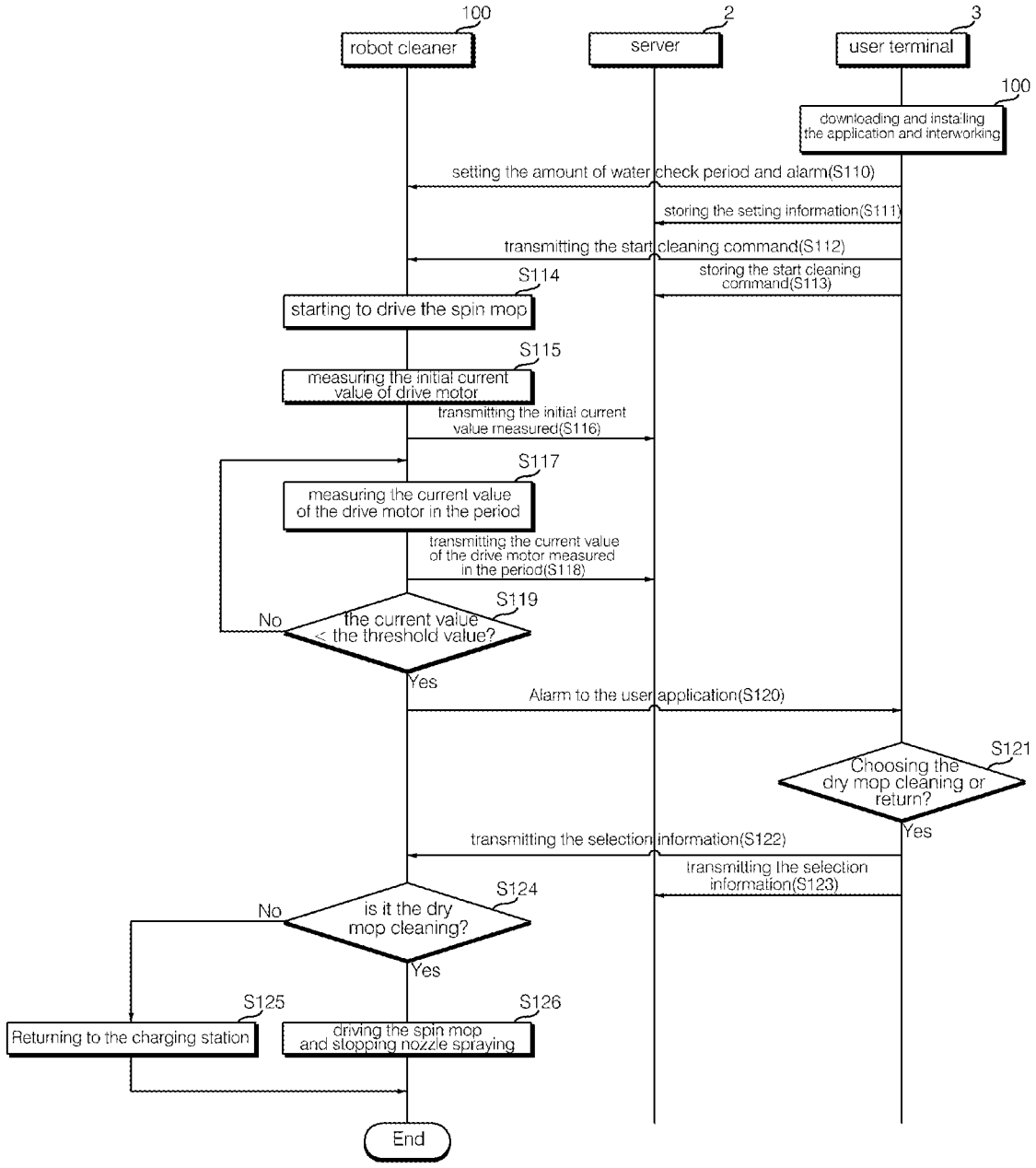
FIG. 8 is a flow chart showing the overall operation of the robot cleaner system of the present disclosure.
Figure 9A:
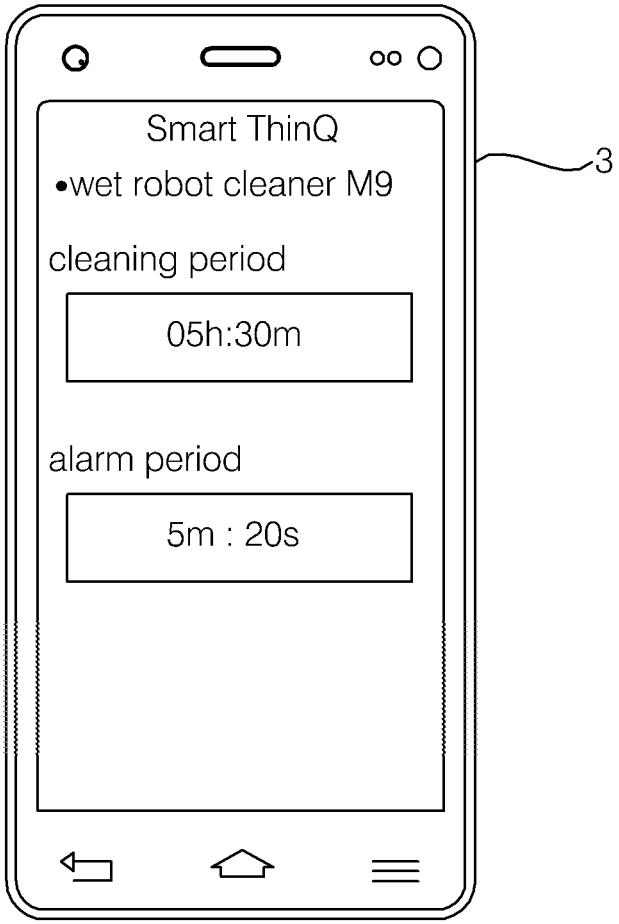
FIGS. 9A and 9B are diagrams showing a state of a user terminal according to FIG. 8.
Figure 9B:
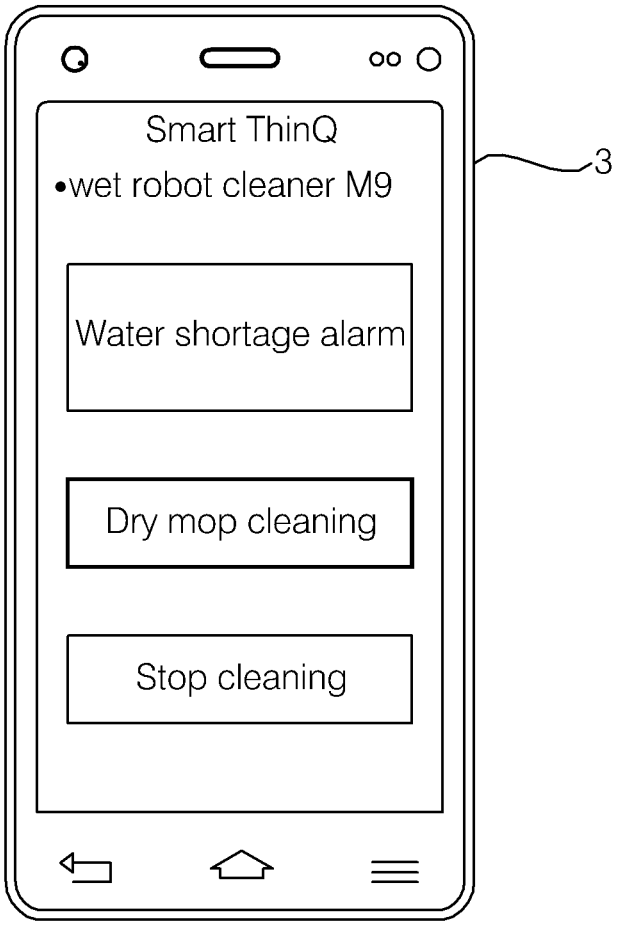

FIG. 7 is a flowchart illustrating a control method of the robot cleaner 100 according to an embodiment of the present disclosure, FIG. 8 is a flowchart illustrating the overall operation of the robot cleaner system of the present disclosure according to FIG. 1, and FIGS. 9*a* and 9*b* are the state diagram of the user terminal for explanation of the flowchart of FIG. 8.

The robot cleaner 100 according to the present embodiment may receive a cleaning start command from an application of the server 2 or the user terminal 3. Also, the robot cleaner 100 may receive a cleaning start command directly from the user through the input unit (S10).

The controller 150 of the robot cleaner 100 controls the drive motor 38 and the pump 34 through the motor controller 160 to start cleaning according to the received cleaning start command.

At this time, the controller 150 may read the initial current value of the drive motor 38 that rotates the spin mop and set the initial value (S11).

The controller 150 transmits a control signal to the motor controller 160 to rotate the spin mop and proceed with cleaning. Spin mops also performs wet cleaning in a state including a predetermined water quantity according to water injection from a nozzle driven by the pump 34.

At this time, the controller 150 may proceed with cleaning intensity and traveling by controlling the rotational direction and rotational speed of the spin mop, and perform cleaning while driving in a predetermined mode according to the cleaning area.

The controller 150 controls the motor controller 160 to read the output current of the drive motor 38 of the spin mop every predetermined period (S12).

The motor controller 160 may read the output current of the drive motor 38 and periodically transmit it to the controller 150, and supply power to the drive motor 38 to drive the drive motor 38.

The controller 150 receives the output current of the drive motor 38 received according to each period, and analyzes it to determine the current water quantity of the spin mop, the slip rate of the spin mop, and the state of the floor accordingly.

Hereinafter, the operation of the controller 150 to determine the water quantity of the spin mop according to the output current and to determine whether or not water is insufficient accordingly is described.

That is, the controller 150 receives the output current value of the motor 38 of the current period, and determines whether the output current value is less than the threshold value (S13).

At this time, the threshold value indicates that the water quantity of the spin mop has reached the minimum value, and when the output current is smaller than the threshold value, it may be determined that the wet cleaning cannot be performed.

At this time, the controller 150 may read whether the operation of the pump 34 providing water through the nozzle is normally performed, and determine whether the current water supply is abnormal.

That is, when the operation of the pump 34 proceeds normally, if the output current value is less than the threshold value, it is determined that the amount of water contained in the water tank 32 is insufficient, and accordingly the controller 150 alarms the lack of water in the robot cleaner 100 to the application of the user terminal 3. (S15). The alarm may include both sound and video information, and may be periodically alarmed.

At this time, the controller 150 may stop the spraying of the water by stopping the operation of the pump 34, and may stop traveling or return to the charging station 200 (S16).

Meanwhile, when the operation of the pump 34 is not normally performed in the corresponding period, the controller 150 may control alarm and operation according to the malfunction of the pump 34.

Alternatively, if the operation of the pump 34 proceeds normally and the output current value is greater than or equal to the threshold value, it is determined that the water contained in the water tank maintains a predetermined level so far, and cleaning can be continuously performed (S14).

The controller 150 may control the operation of the robot cleaner 100 by receiving and analyzing the output current value of the drive motor 38 and the operation of the pump 34 according to the predetermined period.

As described above, the output current value of the drive motor 38 is periodically received from the motor controller 160 that controls the drive motor 38 and analyzed to determine whether the current water tank is running out of water.

The robot system according to the present embodiment may have a configuration as shown in FIG. 1, and when the robot cleaner 100 performing the operation as shown in FIG. 7 exists in the robot system, the robot cleaner 100 may provide the alarm for water shortage to the user by using the output current value of the drive motor 38 in conjunction with the server 2 and the user terminal 3.

Hereinafter, the control method in the robot system will be described with reference to FIG. 8.

Referring to FIG. 8, the robot cleaner 100, the server 2, and the user terminal 3 perform wireless communication with each other in the robot system including the robot cleaner 100 according to an embodiment of the present disclosure to control the robot cleaner 100.

First, the server 2 of the robot system produces the user application that can control the robot cleaner 100 and holds it in a state that can be distributed online.

The user terminal 3 downloads the user application from online and installs it (S100).

The user terminal 3 executes the application for the user, registers membership and registers the robot cleaner 100 owned by the user to the application, and links the application with the robot cleaner 100.

The user terminal 3 can set various functions for the corresponding robot cleaner 100. Specifically, as shown in FIG. 9*a*, a cleaning period, a setting period for checking the water quantity, and the method for alarming the result of checking the water quantity according to the period, or the like may be set (S110).

The period for checking the water quantity may be preferably 1 to 10 minutes, and more preferably 1 to 6 minutes.

As the alarm method, a sound alarm and a display alarm can be selected, and an alarm period can also be set.

In addition, in addition to displaying the alarm on the application of the user terminal 3 as the alarm method, the robot cleaner 100 itself provides the alarm, so the method for arousing the user's attention can be also selected.

The user terminal 3 transmits data to the server 2 through the application with respect to such setting information, stores it in the server 2 (S111), and is transmits data to the robot cleaner 100 via wireless communication for the water quantity check period and alarm setting information.

Next, the robot cleaner 100 may receive the cleaning start command from the application of the user terminal 3 (S112). At this time, the start information from the application of the user terminal 3 may be transmitted to the server 2 and stored in the server 2 (S113).

The robot cleaner 100 controls the drive motor 38 and the pump 34 through the motor controller 160 to start cleaning according to the received cleaning start command (S114).

At this time, the controller 150 of the robot cleaner 100 may set an initial value by reading the initial current value of the drive motor 38 that rotates the spin mop (S115). The robot cleaner 100 may transmit information about the initial current value measured to the server 2 through the communication unit (S116), and the server 2 may store it.

The controller 150 transmits the control signal to the motor controller 160 to rotate the spin mop and proceed with cleaning. The spin mop also performs wet cleaning in a state including a predetermined water quantity according to water injection from the nozzle driven by the pump 34.

At this time, the controller 150 may proceed with cleaning intensity and driving by controlling the rotational direction and rotational speed of the spin mop, and perform cleaning while traveling in a predetermined mode according to the cleaning area.

The controller 150 controls the motor controller 160 to read the output current of the drive motor 38 of the spin mop every predetermined period (S117). The motor controller 160 may read the output current of the drive motor 38 and periodically transmit it to the controller 150, and supply power to the drive motor 38 to drive the drive motor 38.

The controller 150 receives the output current of the drive motor 38 received according to each period, analyzes it, and determines the water quantity of the current spin mop to determine whether water is insufficient.

Specifically, the robot cleaner 100 measures the current value of the drive motor 38 that rotates the spin mop at the corresponding period. The robot cleaner 100 may transmit information on the current value of the corresponding period measured to the server 2 through the communication unit, and the server 2 may store it (S118).

The controller 150 determines the water quantity of the spin mop according to the output current and determines whether water is insufficient (S119).

That is, the controller 150 receives the output current value of the motor 38 of the current period, and determines whether the output current value is smaller than the threshold value.

At this time, the threshold value indicates that the water quantity of the spin mop has reached the minimum value, and when the output current is smaller than the threshold value, it may be determined that wet cleaning cannot be performed.

At this time, the robot cleaner 100 may determine whether the current water supply is abnormal by reading whether the operation of the pump 34 providing water through the nozzle is normally performed.

That is, when the operation of the pump 34 proceeds normally, if the output current value is less than the threshold value, it is determined that the amount of water contained in the water tank 32 is insufficient, and accordingly the application of the user terminal 3 alarms that the water of the robot cleaner 100 is insufficient (S120).

As shown in FIG. 9*b*, the user terminal 3 may display an information region for the robot cleaner 100 in the corresponding application, and a water shortage alarm may be displayed in the information region.

At this time, the water shortage alarm may periodically flash the user's attention.

The application of the user terminal 3 may induce a command for the next operation of the robot cleaner 100 to the user along with the water shortage alarm.

For example, as shown in FIG. 9*b*, selectable icons for various function may be activated at the bottom or around the water shortage alarm.

Specifically, dry mop cleaning or cleaning stops can be activated by the icons as the next operation.

The user terminal 3 may select one of the icons and transmit the selection information to the robot cleaner 100 (S122).

The robot cleaner 100 analyzes the selection information and when the dry mop cleaning mode is selected (S124), the operation of the pump 34 of the robot cleaner 100 is stopped to stop spraying water from the nozzle (S126). In addition, in the dry mop cleaning mode, it is possible to perform the dry mop cleaning in which the dust and the like can be attached in the state of the dry mop while maintaining the rotation of the spin mop.

Meanwhile, when the cleaning stop icon of the user terminal 3 is selected, the robot cleaner 100 stops both the operation of the pump 34 and the operation of the drive motor 38, thereby spraying water and rotation the spin mop of the robot cleaner 100 are stopped. Therefore, the robot cleaner 100 stops from the current position with the operation stopped (S125).

At this time, when selecting the icon of the cleaning stop according to the setting, it can be set to rotate the spin mop to return to the charging station 200 while the water spray is stopped.

As shown in FIG. 9*b*, the user selects the operation and transmits selection information to the robot cleaner 100 when the water shortage alarm is displayed.

The robot cleaner 100 receiving the selection information reads the selected selection information and performs the operation according to the read information.

That is, when the dry mop cleaning mode is selected as described above, the spin mop maintains rotation, and the spraying of water from the nozzle is stopped to perform the dry mop cleaning.

Meanwhile, when the operation of the pump 34 is not normally performed in the corresponding period, the controller 150 may control alarm and operation according to the malfunction of the pump 34.

Alternatively, if the operation of the pump 34 proceeds normally, and the output current value is greater than or equal to the threshold value, it is determined that the water contained in the water tank 32 maintains a predetermined level so far, and cleaning can be continuously performed.

As such, the controller 150 may control the operation of the robot cleaner 100 by receiving and analyzing the output current value of the drive motor 38 and the operation of the pump 34 together according to a predetermined period.

In addition, when the cleaning stop is selected, the robot cleaner 100 may stop both the operation of the pump 34 and the operation of the drive motor 38, or at this time, only the pump 34 is stopped to return to the charging station 200.

The robot cleaner 100 that is returned to the charging station 200 or stopped at the current position by the cleaning stop can directly is supplied with the water tank 32 by the user, and then the cleaning operation is possible again.

As described above, the output current value of the drive motor 38 is periodically received from the motor controller 160 that controls the drive motor 38 and analyzed to determine whether or not the current water tank 32 is running out of water, thereby inducing water supply.

Such a robot system may have a configuration as shown in FIG. 1, and when the robot cleaner 100 performing the operation as shown in FIG. 7 exists in the robot system, the robot cleaner 100 may provide the alarm for water shortage to the user using the output current value of the drive motor 38 in conjunction with the server 2 and the user terminal 3.

Hereinafter, a control method in a robot system according to another embodiment of the present disclosure is described with reference to FIGS. 10 and 11.

Figure 10:
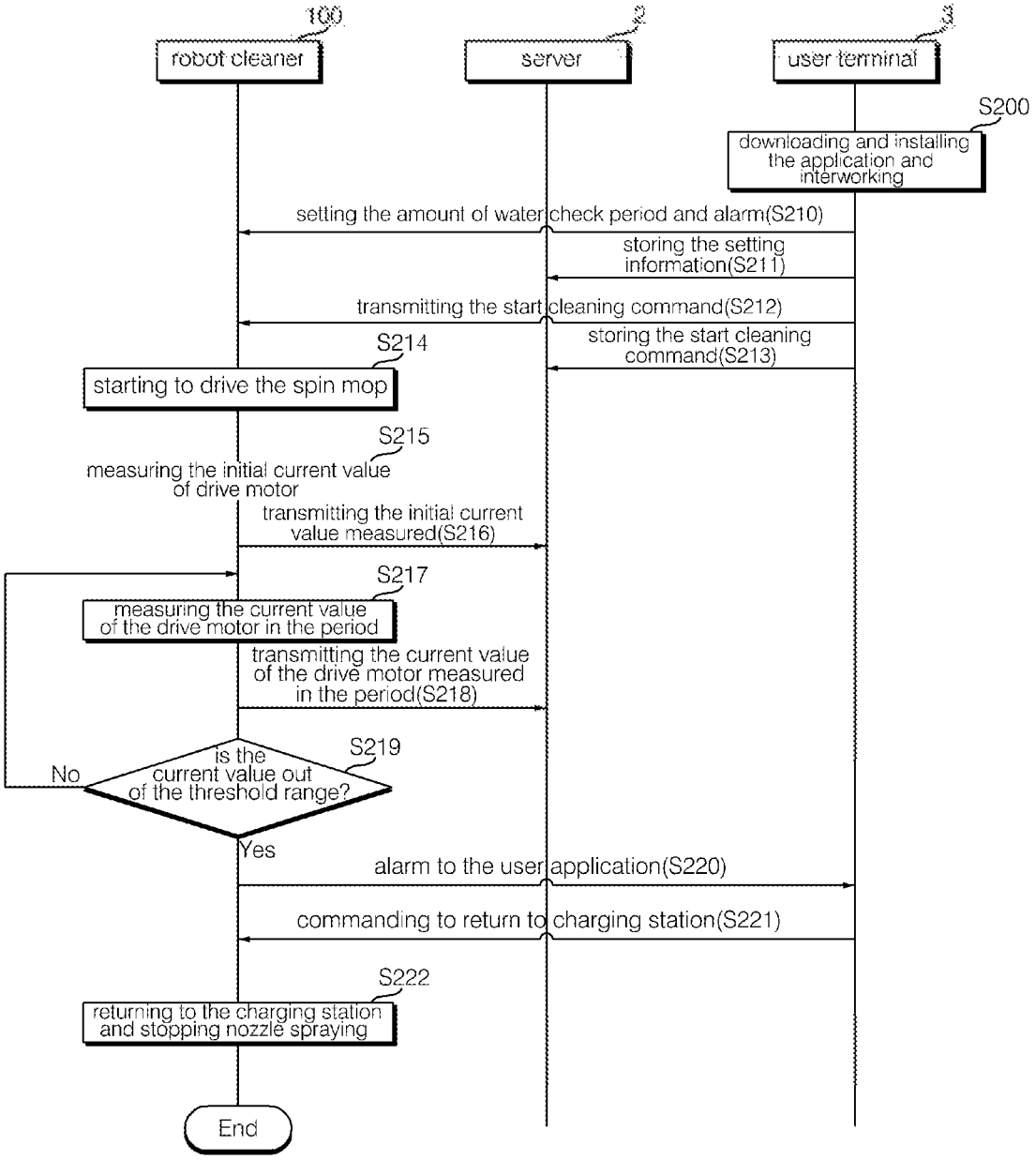
FIG. 10 is a flow chart showing the overall operation of the robot cleaner system according to another embodiment of the present disclosure.
Figure 11:
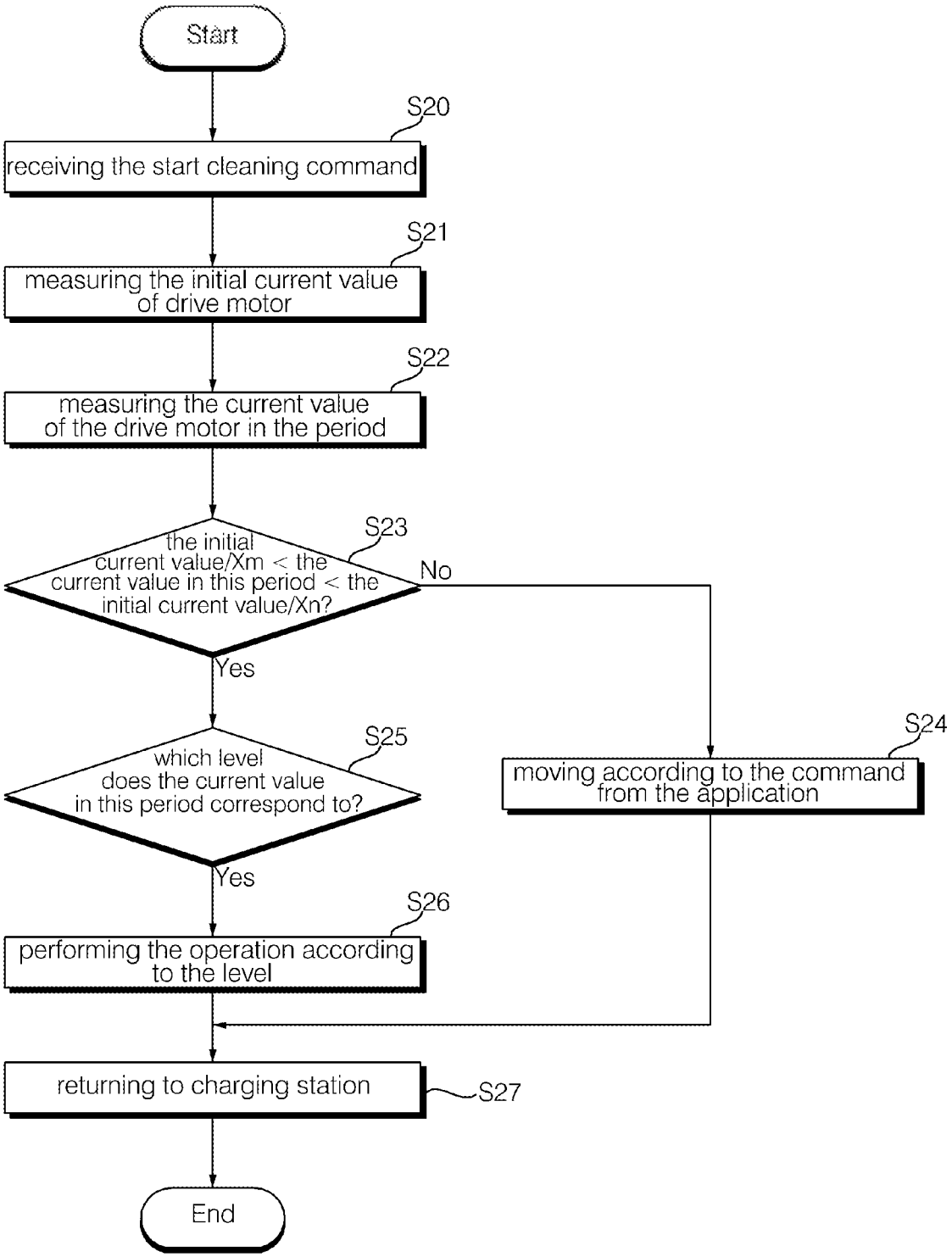
FIG. 11 is a flowchart illustrating a control method of the robot cleaner according to FIG. 10.

FIG. 10 is a flowchart illustrating the overall operation of the robot cleaner 100 system according to another embodiment of the present disclosure, and FIG. 11 is a flowchart illustrating a control method of the robot cleaner 100 according to FIG. 10.

First, referring to FIG. 10, the robot cleaner 100, the server 2, and the user terminal 3 wirelessly communicate with each other to perform control on the robot cleaner 100 in the robot system including the robot cleaner 100 according to another embodiment of the present disclosure.

First, the server 2 of the robot system produces the user application that can control the robot cleaner 100 and keeps it in a state that can be distributed online.

The user terminal 3 downloads the user application from online and installs it (S200).

By executing the application for the user, membership and the robot cleaner 100 owned by the user are registered in the application, and the robot cleaner 100 is interlocked with the application.

The user terminal 3 may set various functions for the corresponding robot cleaner 100, and specifically, a cleaning period, a period for checking the output current of the motor, and an alarm method for checking the floor state according to the period may be set (S210).

The cleaning period may be variously set according to the user's life pattern, but may be set to, for example, a period within 5 hours or 6 hours. In addition, it is possible to set a predetermined time to proceed with cleaning at the corresponding time.

The period for reading the output current of the drive motor 38 for rotating the spin-mop may be preferably 1 to 10 minutes, and more preferably 1 to 6 minutes.

As the alarm method, a sound alarm and a display alarm can be selected, and an alarm period can also be set.

In addition to displaying the alarm on the application of the user terminal 3 as the alarm method, the robot cleaner 100 itself may also provide the alarm to select a method of drawing attention of the user.

The user terminal 3 transmits data to the server 2 through the application for such setting information, and also transmits data through the wireless communication for the checking period of the output current of motor and alarm setting information to the robot cleaner 100 (S211).

Next, the robot cleaner 100 may receive a cleaning start command from the application of the user terminal 3 (S212). At this time, the start information from the application of the user terminal 3 can be transmitted to the server 2 and stored in the server 2 (S213).

The robot cleaner 100 controls the drive motor 38 and the pump 34 through the motor controller 160 to start cleaning according to the received cleaning start command (S214).

At this time, the controller 150 of the robot cleaner 100 may set an initial value by reading the initial current value of the drive motor 38 that rotates the spin mop (S215). The robot cleaner 100 may transmit information about the initial current value measured to the server 2 through the communication unit, and the server 2 may store it (S216).

The controller 150 transmits the control signal to the motor controller 160 to rotate the spin mop and proceed with cleaning. The spin mop also performs wet cleaning in a state including a predetermined water quantity in response to water injection from a nozzle driven by the pump 34.

At this time, the controller 150 may proceed with cleaning intensity and traveling by controlling the rotational direction and rotational speed of the spin mop, and perform cleaning while traveling in a predetermined mode according to the cleaning area.

The controller 150 controls the motor controller 160 to read the output current of the drive motor 38 of the spin mop every predetermined period (S217). The motor controller 160 may read the output current of the drive motor 38 and periodically transmit it to the controller 150, and supply power to the drive motor 38 to drive the drive motor 38.

The controller 150 receives the output current of the drive motor 38 received according to each period, and analyzes it to define the floor state that is in contact with the current spin mop.

Specifically, the robot cleaner 100 measures the current value of the drive motor 38 that rotates the spin mop at the corresponding period. The robot cleaner 100 may transmit information on a current value of a corresponding period measured to the server 2 through the communication unit, and the server 2 may store it (S218).

The controller 150 may select the slip rate of the spin-mop according to the output current, and may determine the floor state according to the selected slip rate (S219).

At this time, the controller 150 may perform the evaluation of the floor state according to the data described in Table 1 as described above.

In addition, the relationship between each slip rate and the floor state may be the same as described above.

At this time, the robot cleaner 100 may be set to continuously clean only in the states of the hard floors 1 to 3 on the floor.

That is, an output current value corresponding to the hard floor 1 to hard floor 3 may be set as the threshold range, and the robot cleaner 100 may determine whether the output current value of the spin mop motor read in the corresponding period is included in the threshold range.

At this time, the controller 150 may determine that the floor state is a floor in a state in which the robot cleaner 100 such as a carpet cannot move when it is out of the threshold range.

The robot cleaner 100 determines that the robot cleaner 100 is restrained when the value of the output current of the drive motor 38 is out of the threshold range, and transmits the corresponding information through the application of the user terminal 3. (S220).

The user terminal 3 may receive the restraint information of the robot cleaner 100 and transmit a station return command by selecting an icon in the corresponding application (S221). At this time, the user terminal 3 may command to stop the operation of the robot cleaner 100 via the application.

The robot cleaner 100 receives such a command from the user terminal 3 and performs an operation accordingly.

That is, upon receiving the station return command, the water jet of the nozzle is stopped, and the robot cleaner 100 returns to the charging station 200 to stop traveling (S222).

Alternatively, it is possible to separate and decide whether it is possible to move or not according to the value of the current representing the restraint, and it is possible to control and separate whether it is difficult to move due to high frictional force such as a carpet with short hair, but if it is possible to move, or it is impossible to move because it is blocked from the obstacle.

That is, in the case of the restraint state in which movement is not possible at all, it is possible to command the operation stop at the current position, not return to the station 200.

As such, the robot cleaner 100 may periodically read the output current value of the drive motor 38 to check information about the current floor state and control the operation accordingly.

At this time, the controller 150 of the robot cleaner 100 may distinguish the floor state according to the light information received by the cliff sensor, which may additionally include, and fuse the image information accordingly to determine the current floor state.

Meanwhile, when the robot cleaner 100 according to another embodiment of the present disclosure reads the output current of the drive motor 38 and determines the floor state, the robot cleaner 100 may perform an operation as illustrated in FIG. 11.

Referring to FIG. 11, the robot cleaner 100 controls the drive motor 38 and the pump 34 through the motor controller 160 to start cleaning according to the received cleaning start command (S20).

At this time, the controller 150 of the robot cleaner 100 may set an initial value by reading the initial current value of the drive motor 38 that rotates the spin mop (S21). The robot cleaner 100 may transmit information about the initial current value measured to the server 2 through the communication unit, and the server 2 may store it.

The controller 150 transmits the control signal to the motor controller 160 to rotate the spin mop and proceed with cleaning. The spin mop also performs wet cleaning in a state including a predetermined water quantity in response to water injection from a nozzle driven by a pump 34.

At this time, the controller 150 may proceed with cleaning intensity and traveling by controlling the rotational direction and rotational speed of the spin mop, and perform cleaning while traveling in a predetermined mode according to the cleaning area.

The controller 150 controls the motor controller 160 to read the output current of the drive motor 38 of the spin mop every predetermined period (S22). The motor controller 160 may read the output current of the drive motor 38 and periodically transmit it to the controller 150, and supply power to the drive motor 38 to drive the drive motor 38.

The controller 150 receives the output current of the drive motor 38 received according to each period, and analyzes it to define the floor state that is in contact with the current spin mop.

Specifically, the robot cleaner 100 measures the current value of the drive motor 38 that rotates the spin mop at the corresponding period. The robot cleaner 100 may transmit information about the current value of a corresponding period measured to the server 2 through the communication unit, and the server 2 may store it.

The controller 150 may set the threshold range based on the initial current value of the robot cleaner 100 and determine whether the current value of the corresponding period satisfies the threshold range (S23).

Specifically, when the initial current value is Iin, the controller 150 may satisfy Equation 1 below.

$$Iin*m<Ith<Iin*n \quad \text{[Equation 1]}$$

m may be a real number less than 1, and preferably 0.3 to 0.6.

Further, n may be a positive number greater than 1, and preferably 3 to 5.

As described above, when the threshold range is set based on the initial current value, it is possible to specifically determine a case where there is a sudden change in the situation applied at the starting point of the cleaning.

That is, the user terminal 3 may notify that the floor state in the current period has changed rapidly when the change amount is large from the initial value.

Such a notification may occur when it is out of the range of Equation 1 as shown in FIG. 11, and if it is out of the range, it may be returned to the station 200 by performing the movement according to an instruction through the application from the user terminal 3 (S24).

Meanwhile, when the output current value of the motor of the current period satisfies within the threshold range of Equation 1, the evaluation of the floor state may be performed according to the data in Table 1.

At this time, the robot cleaner 100 may determine whether the floor state corresponds to one of the states of the hard floor 1 to the hard floor 3, and update the data accordingly (S25).

In addition, wet cleaning may be performed while controlling the rotational speed of the motor 38 according to the floor state.

The robot cleaner 100 may perform wet cleaning of the cleaning area while controlling the rotational speed of the motor according to the floor state, return to the charging station 200 when the cleaning is finished, update the information about the termination, and transmit the information to the server 2 (S27).

As described above, without a separate sensor or control module, the robot cleaner 100 performs the evaluation on whether the water tank 32 is short of water and the floor state only with the output current of the driving motor 38 that rotates the spin mop, thereby, the disadvantages of wet cleaning can be eliminated.

In the above, preferred embodiments of the present disclosure have been illustrated and described, but the present disclosure is not limited to the above-described specific embodiments, and the technical field to which the present disclosure pertains without departing from the gist of the present disclosure claimed in the claims. Of course, various modifications can be made by those skilled in the art, and these modifications should not be individually understood from the technical idea or prospect of the present disclosure.

[EXPLANATION OF REFERENCE NUMERAL]

| | | | |
|---|---|---|---|
| 100: | robot cleaner | 2: | server |
| 3: | user terminal | 10: | main body |
| 32: | water tank | 34: | pump |
| 38: | drive motor | 80: | rotary mop |

-continued

| [EXPLANATION OF REFERENCE NUMERAL] | | | |
|---|---|---|---|
| 150: | controller | 160: | motor controller |
| 130: | storage unit | 140: | input unit |

What is claimed is:

1. A robot cleaner comprising:

a main body forming an outer shape;

a water tank configured to contain water;

a pair of rotary mops configured to rotate in contact with a floor to move the main body;

a drive motor configured to rotate the pair of rotary mops;

a pump connected to the water tank, the pump being configured to drive a nozzle to inject the water to the rotary mops; and a controller configured to:

determine whether there is a shortage of water in the water tank based on an output current of the drive motor, the output current being indicative of a water content of the rotary mops;

stop operation of the pump according to a user input; and initiate cleaning in a dry mop state when the output current of the drive motor is less than a threshold value.

2. The robot cleaner of claim 1, wherein the controller is further configured to periodically read the output current of the driving motor, and determine that there is the shortage of water in the water tank when the output current is less than the threshold value.

3. The robot cleaner of claim 2, wherein the threshold value corresponds to a minimum water content value suitable for wet cleaning.

4. The robot cleaner of claim 1, wherein the controller is further configured to determine an operating state of the pump based on a comparison of the output current of the drive motor to the threshold value.

5. The robot cleaner of claim 1, wherein the controller is further configured to determine that there is the shortage of water in the water tank when the output current of the drive motor is less than the threshold value and the pump is operating normally.

6. The robot cleaner of claim 1, wherein the controller is further configured to read the output current of the drive motor to determine a current floor state.

7. The robot cleaner of claim 6, wherein the controller is further configured to determine the current floor state based on a look-up table correlating to the output current of the drive motor to the floor state.

8. The robot cleaner of claim 6, wherein the controller is further configured to determine that the floor state is sufficient to perform wet cleaning when the output current of the drive motor is within a threshold range, and wherein the controller is further configured to determine that the robot cleaner is constrained so that it cannot move when the output current exceeds the threshold range.

9. The robot cleaner of claim 8, wherein the threshold range comprises a predetermined range based on an initial output current of the drive motor at a start of a cleaning.

10. The robot cleaner of claim 1, wherein the controller is further configured to determine at least one of whether the robot cleaner has returned to a charging station or whether the robot cleaner has stopped at the current position based on the output current of the drive motor.

11. The robot cleaner of claim 1, further comprising a cliff sensor having one or more light emitting elements and one or more light receiving elements to determine a floor state in the cleaning area, wherein the controller is configured to determine the floor state based on the output current of the drive motor and an amount of light received by the cliff sensor.

12. A robot system comprising:

a robot cleaner configured to perform a wet cleaning operation in a cleaning area;

a server configured to communicate with and control the robot cleaner; and a user terminal configured to allow control of the robot cleaner by activation of an application for interacting with the robot cleaner and the server, wherein the robot cleaner comprises:

a pair of rotary mops configured to rotate in contact with a floor to move a main body;

a drive motor configured to rotate the pair of rotary mops;

a pump connected to a water tank, the pump being configured to drive a nozzle to inject the water to the rotary mops; and a controller configured to:

determine whether there is a shortage of water in the water tank based on an output current of the drive motor, the output current being indicative of a water content of the rotary mops;

stop operation of the pump according to a user input; and initiate cleaning in a dry mop state when the output current of the drive motor is less than a threshold value.

13. The robot system of claim 12, wherein the controller is further configured to periodically read the output current of the driving motor, and determine that there is the shortage of water in the water tank when the output current is less than the threshold value.

14. The robot system of claim 12, wherein the controller is further configured to determine an operating state of the pump based on a comparison of the output current of the drive motor to the threshold value.

15. The robot system of claim 12, wherein the controller is further configured to determine that there is the shortage of water in water tank, and transmit an alarm signal to the user terminal when the output current of the drive motor is less than the threshold value and the pump is operating normally.

16. The robot system of claim 12, wherein the user terminal is configured to control operation of the robot cleaner by:

displaying an icon indicative of at least one of a dry mop cleaning or a cleaning stop, and transmitting an action of the dry mop cleaning or the cleaning stop selected by the icon to the robot cleaner when the output current of the drive motor is less than the threshold value.

17. The robot system of claim 12, wherein the controller is further configured to read the output current of the drive motor to determine a current floor state.

18. The robot system of claim 17, wherein the controller is further configured to determine the current floor state based on a look-up table correlating to the output current of the drive motor to the floor state.

19. The robot system of claim 12, wherein the controller is further configured to determine that a current floor state is sufficient for wet cleaning when the output current of the drive motor is within a threshold range, and transmit an alarm signal to the user terminal indicating that the robot cleaner is constrained so that it cannot move when the output current exceeds the threshold range.

* * * * *